US006345884B1

(12) United States Patent
Yoon et al.

(10) Patent No.: US 6,345,884 B1
(45) Date of Patent: Feb. 12, 2002

(54) ELECTROSTATIC ATTRACTION TYPE INK JETTING APPARATUS AND A METHOD FOR MANUFACTURING THE SAME

(75) Inventors: Yong-Seop Yoon, Seoul; Hee-Kwon Ko; Kyoung-Jin Park, both of Suwon, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/705,946

(22) Filed: Nov. 6, 2000

(30) Foreign Application Priority Data

Nov. 4, 1999 (KR) ..... 99-48558

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261, 700; 310/328–330; 29/890.1

*Primary Examiner*—Raquel Yvette Gordon
(74) *Attorney, Agent, or Firm*—Robert E. Bushnell, Esq.

(57) ABSTRACT

An electrostatic attraction type inkjetting apparatus including aboard having an ink chamber for receiving ink and a nozzle hole extending from the ink chamber to the extreme end of the board and thus open at the extreme end of the board; a membrane laminated on the board; a lower electrode received in the ink chamber; and an upper electrode disposed on the outer surface of the membrane. By the electrostatic attraction generated during an electric potential difference application between the upper and lower electrodes, the membrane is deformed inward to the ink chamber to press the ink of the ink chamber. Thus, the ink is jetted outward through the nozzle hole. Since the membrane and the driving section are integrally formed with each other, the manufacturing process becomes simpler, and electrostatic attraction generation, and ink discharge are performed efficiently.

12 Claims, 9 Drawing Sheets

ELECTROSTATIC ATTRACTION TYPE INK JETTING APPARATUS AND A METHOD FOR MANUFACTURING THE SAME

CLAIM OF PRIORITY

This application makes reference to, incorporates the same herein, and claims all benefits accruing under 35 U.S.C. §119 from my application INK JETTING APPARATUS AND A METHOD FOR MANUFACTURING THE SAME filed with the Korean Industrial Property Office on Nov. 4 1999 and there duly assigned Ser. No. 48558/1999.

BACKGROUND OF THE INVENTION

1. Field of the Invention

The present invention relates to ink jetting apparatuses such as ink-jet printers, facsimile machines, etc., and more particularly to an electrostatic attraction type ink jetting apparatus having a united ink chamber and working fluid chamber capable of performing an ink jetting operation without requiring a separate working fluid chamber.

2. Description of the Related Art

Generally, ink jetting apparatuses employed in printer heads of output apparatuses such as ink-jet printers, facsimile machines, etc., jet ink in an ink chamber through a nozzle with a physical force. Such ink jetting apparatuses are grouped into a thermal type, electrostatic attraction type, piezoelectric type, and thermal-compression type according to the way of exerting physical force to the ink.

As is often the case, the process for making ink jetting apparatuses is cumbersome, complicated, lengthy and therefore expensive. Many of these processes require forming a working fluid chamber and then an ink chamber on top of the working fluid chamber. What is needed is a more simplified structure and process for forming an ink jetting apparatus. Furthermore, conventional inkjetting apparatuses require a large voltage in order to expel the ink. What is needed is a process and a structure that can expel ink with less voltage.

SUMMARY OF THE INVENTION

The present invention has been made to overcome the above-described problems of the earlier systems, and accordingly, it is an object of the present invention to provide an electrostatic attraction type ink jetting apparatus and manufacturing method thereof having a simpler manufacturing process, efficient generation of electrostatic attraction, and efficient ink discharge by integrally making the membrane together with the driving section.

Another object of the present invention is to provide an electrostatic attraction type ink jetting apparatus and manufacturing method thereof having simpler manufacturing processes by integrally forming the working fluid chamber with the ink chamber.

The above objects are accomplished by the electrostatic attraction type inkjetting apparatus according to the present invention, including: a board having an ink chamber for receiving ink supplied from an external ink supply, and a nozzle hole extending from the ink chamber to an extreme end of the board, being open at the extreme end of the board; a membrane laminated on the board; a lower electrode accommodated in the ink chamber; and an upper electrode disposed on the outer surface of the membrane. The membrane is deformed by electrostatic attraction generated while an electric potential difference is applied between the upper and lower electrodes, and the membrane is thus curved inward the ink chamber to press the ink in the ink chamber and to jet the ink outward through the nozzle hole. The membrane and upper electrode include an ink supply hole formed through the membrane and upper electrode for supplying the ink to the ink chamber therethrough.

Meanwhile, the above objects are accomplished by a method for making the electrostatic attraction type ink jetting apparatus according to the present invention, including the steps of: 1) forming an ink chamber and a nozzle hole by etching, the ink chamber for receiving ink supplied from an external ink supply and a nozzle hole extending from the ink chamber to an extreme end of a wafer and thus open at the extreme end of the wafer; 2) vapor-depositing a lower electrode in the ink chamber; 3) adhering a polyamide sheet on the wafer; 4) forming a membrane by etching the polyamide sheet; and 5) vapor-depositing an upper electrode on the membrane. Here, the step of forming the ink chamber and nozzle hole is performed by wet-etching, while the step of forming the membrane is performed by dry-etching.

Further, after the step of adhering the upper electrode, the step of forming an ink supply hole through the membrane and upper electrode for serving the function of a supply channel for ink supplied from the external ink supply to the ink chamber is performed. Here, the step of forming the ink supply hole includes the sub-steps of: a) forming an ink supply hole of the upper electrode by photo-engraving the upper electrode; and b) forming the ink supply hole of the membrane by dry-etching the membrane. In the electrostatic attraction type ink jetting apparatus and manufacturing method thereof according to the present invention, the manufacturing process becomes simpler, and driving is performed rapidly.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
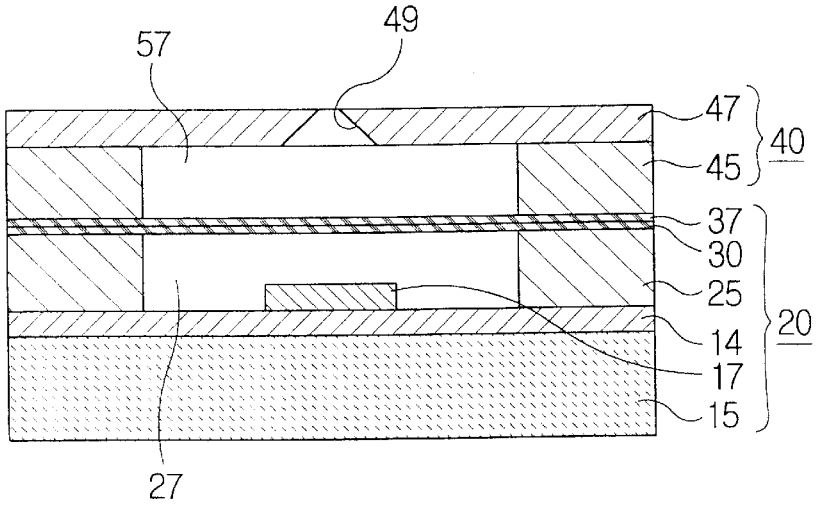
FIG. 1 (Related Art)
FIG. 1 is a sectional view of a conventional electrostatic attraction type ink jetting apparatus.

The present invention will be hereinafter described in greater detail with reference to accompanying drawings. Here, the construction of the nozzle section is identical to the construction of the conventional ink jetting apparatus shown in FIG. 1, and accordingly, further description thereof will be omitted. Further, the like elements will be given the same reference numerals throughout.

An electrostatic attraction type ink jetting apparatus is shown in FIG. 1. The ink jetting apparatus includes a driving section 20 and a nozzle section 40. The driving section 20 includes a board 15, an oxide film laminated on the board 15, a working fluid barrier 25 having a working fluid chamber 27, a lower electrode 17 disposed within the working fluid chamber 27, a membrane 30 disposed on the working fluid chamber 27, and an upper electrode 37 disposed on the membrane 30. The working fluid chamber 27 may either be maintained at a vacuum state, or may be filled with working fluid which has high dielectric constant enough to accelerate the electrostatic attraction generation (described later).

The nozzle section 40 includes an ink chamber barrier 45 having an ink chamber 57, and a nozzle plate 47 which is united with the upper portion of the ink chambre barrier 45. On the nozzle plate 47, a nozzle opening 49 is formed to jet the ink in the ink chamber 57 therethrough. To the ink chamber 57, ink is consistently supplied from an ink supply (not shown).

As voltage is applied to the upper and lower electrodes 37 and 17 so as to generate electric potential difference therebetween, the membrane 30 is curved inward to the working fluid chamber 27 by the electric potential difference. Here, the force that deforms the membrane 30 is obtained by the following formula:

$$F=e\ A\ V^2/2\ D^2$$

where, e is the dielectric constant within the working fluid chamber 27, A is the area of the upper electrode 37, V is the electric potential difference between the upper and lower electrodes 37 and 17, and D is the distance between the upper and lower electrodes 37 and 17.

As the membrane 30 is deformed, the pressure in the ink chamber 57 decreases, and accordingly, the ink from an ink source is sucked into the ink chamber 57. Then, as the voltage is cut off and the electric potential difference is not generated between the upper and lower electrodes 37 and 17, the membrane 30 recovers its original shape. Here, the pressure in the ink chamber 57 increases, and the ink of the ink chamber 57 is discharged through the nozzle opening 49. As described above, by the repetitious electric potential difference supplies and cut-offs, the ink discharge is performed.

The driving section 20 of the electrostatic attraction type ink jetting apparatus is made as follows: FIGS. 2 to 9 show processes for assembling the driving section 20 of the conventional electrostatic attraction type ink jetting apparatus. In order to produce the driving section 20, the membrane 30 and other components are made, separately, and then assembled together.

Figure 2:
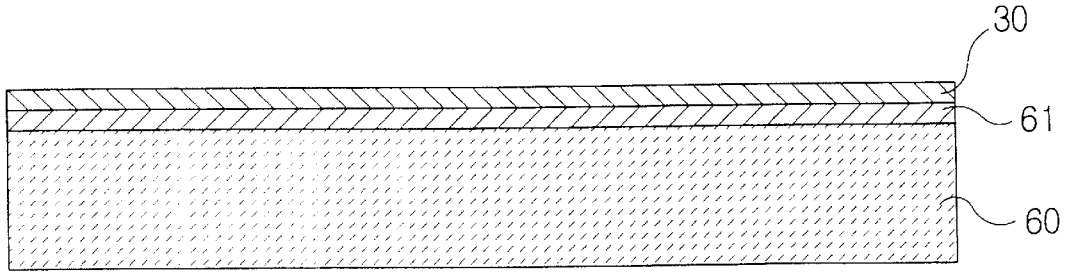
FIG. 2 (Related Art)
FIGS. 2 through 9 are views for sequentially showing a process for making a driving section of the inkjetting apparatus shown in FIG. 1.
Figure 3:
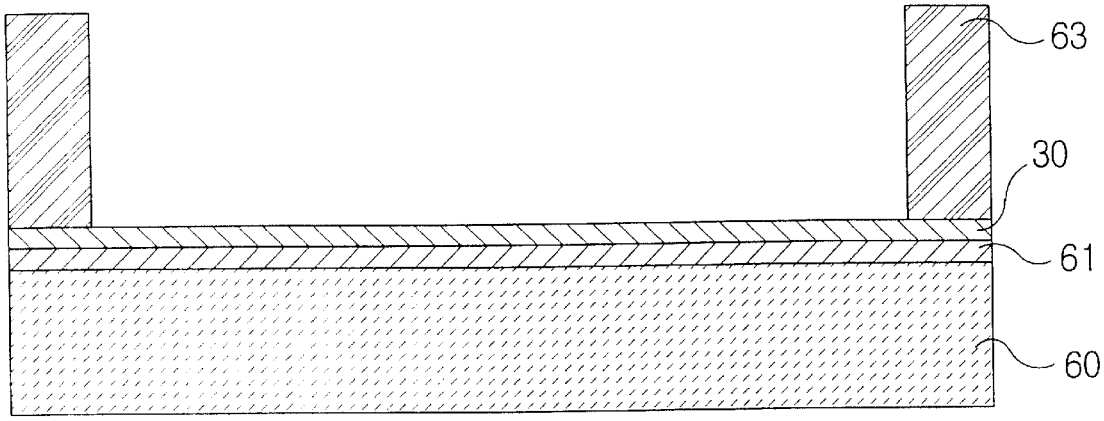
FIG.3 (Related Art)

Next, as shown in FIG. 2, a polyamide material membrane 30 is applied on an oxide film 61 which is vapor-deposited on the board 60 by a spin coater. Then as shown in FIG. 3, an O-ring 63 made of quartz glass is attached on the membrane 30. Then as shown in FIG. 4, the board 60 and the oxide film 61 are separated from the membrane 30, leaving the membrane 30 only.

Figure 5:
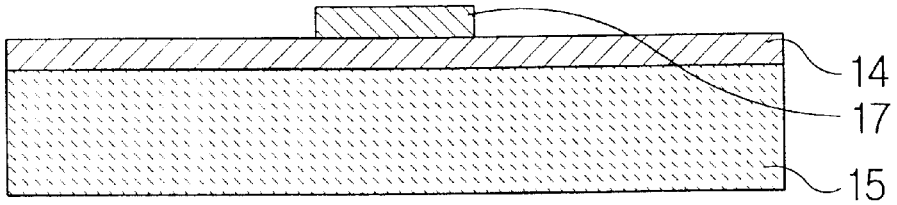
FIG.5 (Related Art)
Figure 6:
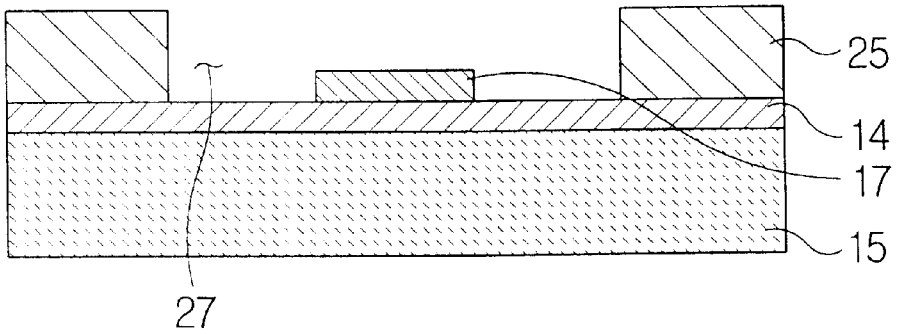
FIG.6 (Related Art)

As shown in FIG. 5, through a photo engraving process, a lower electrode 17 is formed on the oxide film 14 vapor-deposited on the board 15. Next, as shown in FIG. 6, a working fluid barrier 25 is made on the oxide film 14 on the board 15. The ink chamber barrier 25 is formed as the polyamide is applied on the oxide film 14 by the spin coater, and then the central portion thereof is etched by the photo-engraving process.

Figure 4:
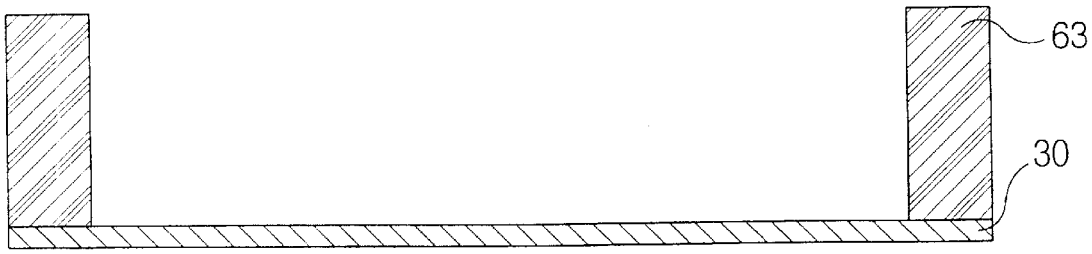
FIG.4 (Related Art)
Figure 7:
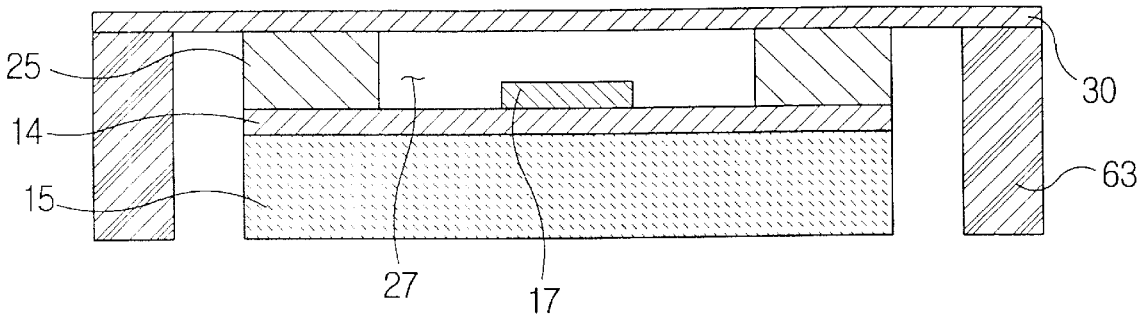
FIG.7 (Related Art)
Figure 8:
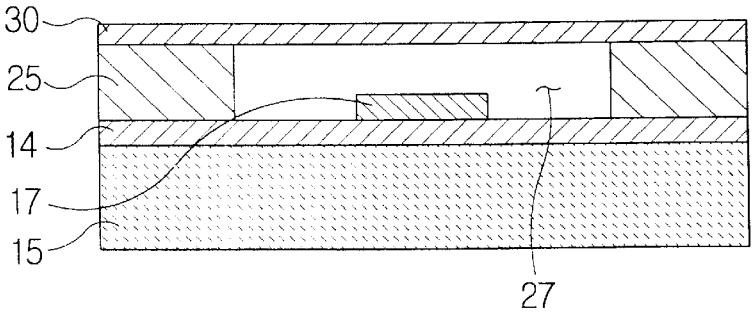
FIG.8 (Related Art)
Figure 9:
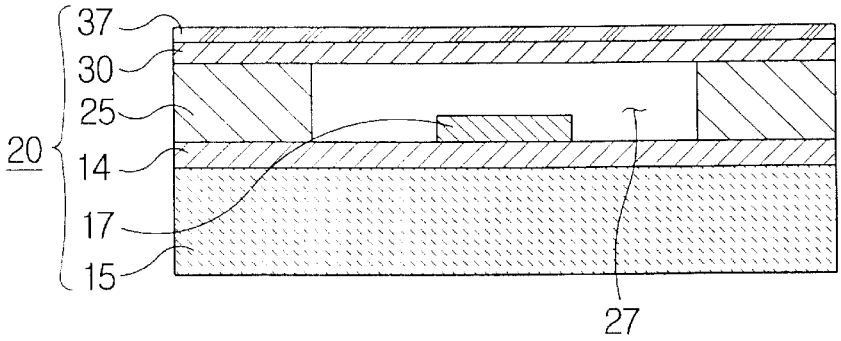
FIG.9 (Related Art)

When the ink chamber barrier 25 is completed, as shown in FIG. 7, the membrane 30 shown in FIG. 4 is overturned and the O-ring 63 of the membrane 30 is aligned with and attached to the upper portion of the working fluid barrier 25. Then, as shown in FIG. 8, the O-ring 63 is removed. Also, as shown in FIG. 9, the upper electrode 37 is vapor-deposited on the membrane 30, resulting in a complete form of the driving section 20. After that, by attaching the nozzle section 40 on the driving section 20 through a separate assembling process, the electrostatic attraction type inkjetting apparatus is completed.

The conventional inkjetting apparatus, however, has the following shortcomings. Those are, the membrane 30 is made separately, requiring several processes such as the O-ring 63 adhering process, and board 60 separating process, etc. Accordingly, additional processes are required to adhere the membrane 30 to the working fluid barrier 25, while a wafer is additionally consumed to make the membrane 30.

Further, in the conventional ink jetting apparatus, since the working fluid chamber 27 and the ink chamber 57 are separated from each other, the driving section 20 and the nozzle section 40 having the working fluid chamber 27 and the ink chamber 57 have to be made separately, making the assembling process more complex.

In order to overcome the above-mentioned shortcomings, an electrostatic attraction type ink jetting apparatus has been suggested, in which the ink chamber barrier 25 of the nozzle section 40 and the membrane 30 are integrally made with each other while making the nozzle section 40. According to such an ink jetting apparatus, since the ink chamber barrier 25 and the membrane 30 are integrally formed with each other, the number of assembling processes is reduced. In such an ink jetting apparatus, since it is difficult to make the upper electrode 37 for generating the electrostatic attraction between the lower electrode 17, the conductivity is increased by doping the area corresponding to the membrane 30.

In the above-described ink jetting apparatus, however, there is a shortcoming in that a fine gap between the lower electrode 17 and the membrane 30 can not be maintained. According to the above-mentioned formula ($F=e\ A\ V^2/2\ D^2$), the electrostatic attraction increases as the gap between the lower and upper electrodes 17 and 37 decreases. In the above-described inkjetting apparatus, the gap between the lower and upper electrodes 17 and 37 increases, and accordingly requires greater electric potential difference to generate a proper degree of electrostatic attraction. Further, by the method for the above-mentioned inkjetting apparatus, it is difficult to make the thin membrane 30, and accordingly requires greater electrostatic attraction. Further, the above-mentioned ink jetting apparatus also has a shortcoming in that the working fluid chamber 27 and the ink chamber 57 still have to be made by separate processes.

Figure 10A:
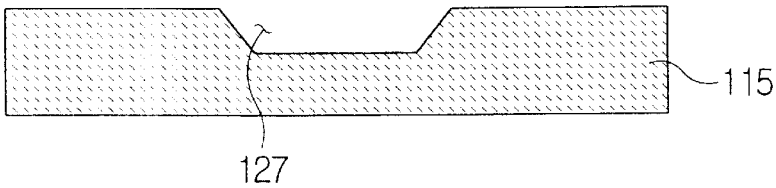
FIGS. 10A through 14 are views for sequentially showing the process for making an ink jetting apparatus according to the present invention.
Figure 10B:
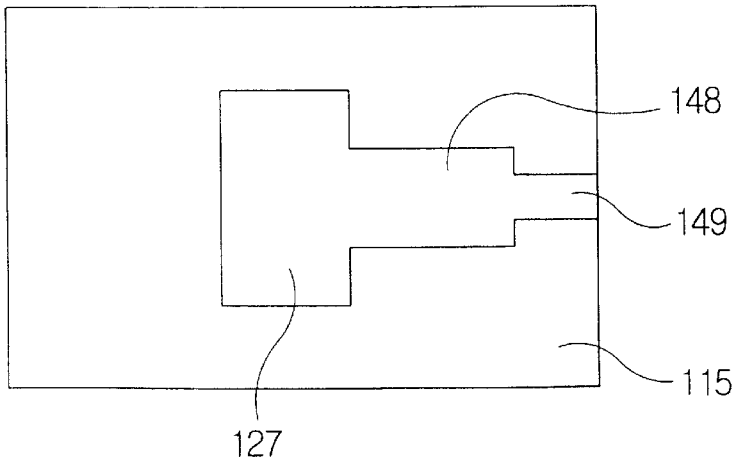

FIGS. 10A to 14 sequentially show a process for making the ink jetting apparatus according to the present invention. First, as shown in FIGS. 10A and 10B, an ink chamber 127, an ink discharge channel 148, and a nozzle opening 149 are formed by etching a wafer 115 which serves the function of a board. The ink chamber 127 holds the ink supplied from an external ink supply (described later). The ink discharge channel 148 and the nozzle opening 149 are integrally formed with the ink chamber 127. More specifically, the ink discharge channel 148 and the nozzle opening 149 extend from the ink chamber 127 to an extreme end of the wafer 115, and thus open at the extreme end of the wafer 115.

The ink chamber 127 is formed by: masking silicon nitride over the necessary area excluding the ink chamber 127 formation area; and performing wet-etching. The depth of etch is adjusted by adjusting etching time and solution density. Further, it is preferable that a wafer having an orientation of 100 be employed to maintain a proper inclination when the silicon wafer 115 is wet-etched. More specifically, since the wafer having an orientation of 100 is etched while maintaining an angle of 54.74° with respect to the horizontal surface, and step coverage is improved when vapor depositing metals for making electrodes.

Figure 11A:
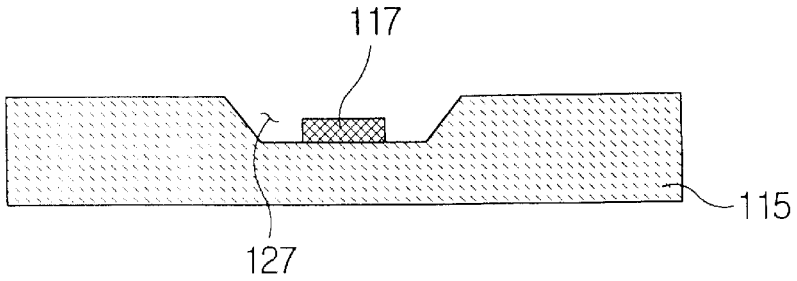
Figure 11B:
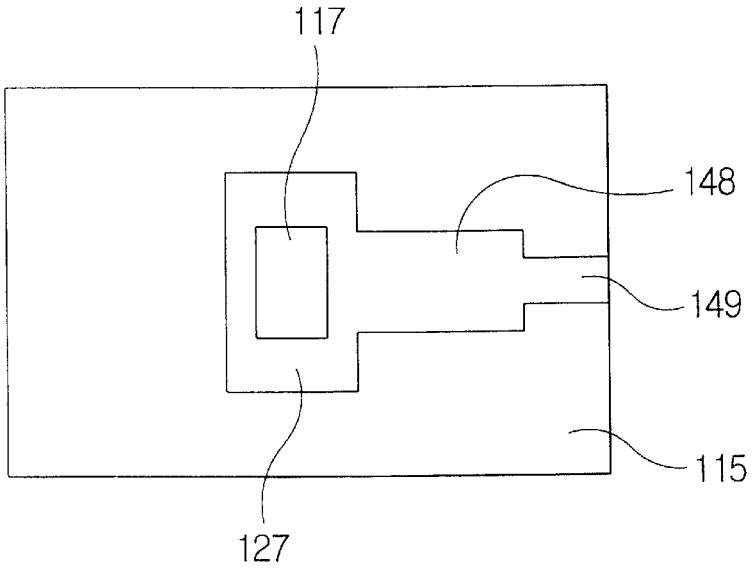
Figure 12:
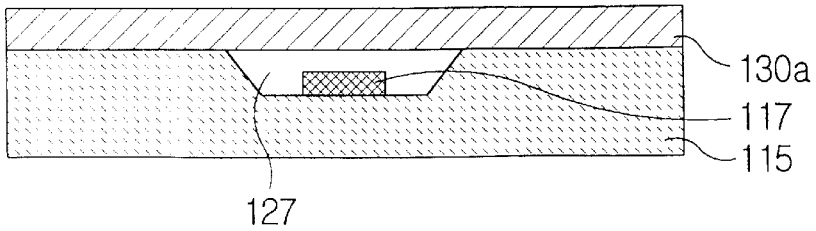

After etching the ink chamber 127, an insulating layer (not shown) formed of oxide film or nitride film is vapor-deposited on the wafer 115, and as shown in FIGS. 11A and 11B, the lower electrode 117 is vapor-deposited in the ink chamber 127 by the photo-engraving process. Then, as shown in FIG. 12, a polyamide sheet 130*a* is attached by a lamination method.

Figure 13A:
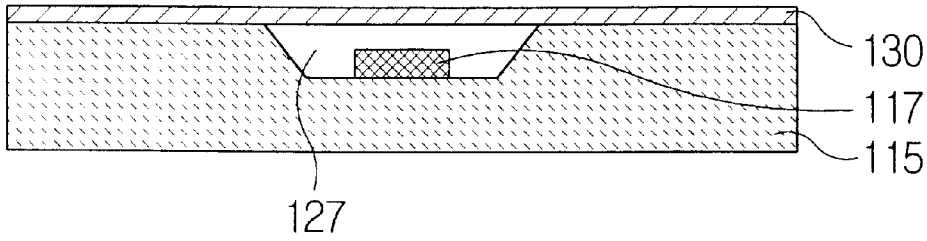
Figure 13B:
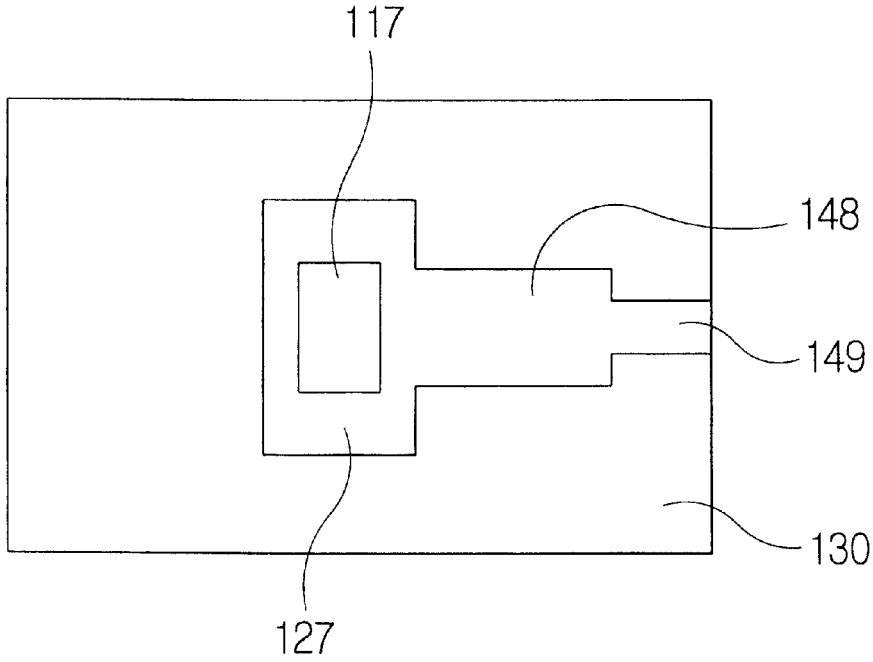

By etching the polyamide sheet 130*a*, the membrane 130 shown in FIGS. 13A and 13B is obtained. In order to drive the membrane 130 at a low voltage, the thickness thereof should be as thin as several micrometers. Here, since the polyamide sheet 130*a* has a thickness of several tens of micrometers, the polyamide sheet 130*a* is etched to obtain the membrane 130 having the thickness appropriate for deformation by electrostatic attraction. Here, the polyamide sheet 130*a* is etched by a dry etching. Since the polyamide sheet 130*a* is etched by dry etching, the membrane 130 having the desired thickness can be easily obtained.

Figure 14A:
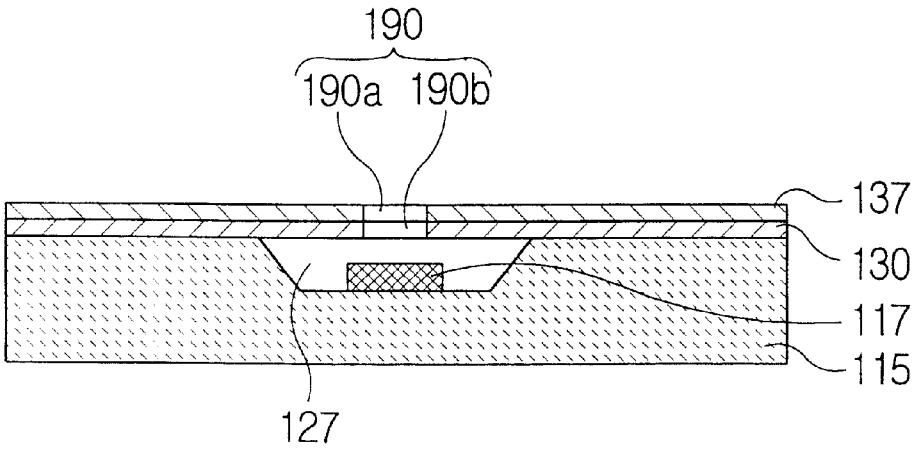
Figure 14B:
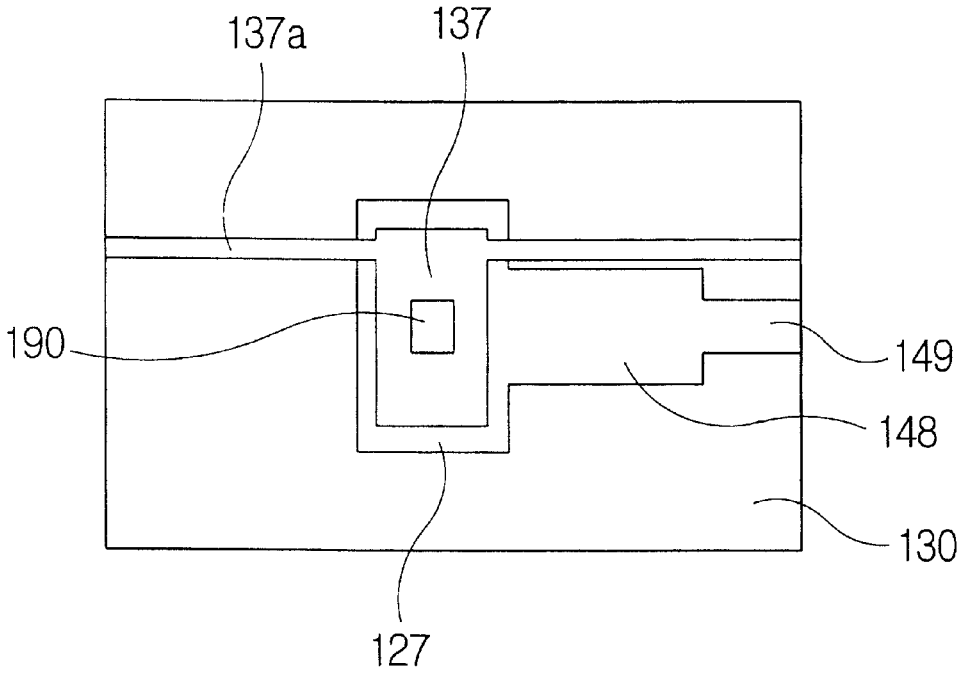

After completion of the membrane 130, the metal layer is vapor-deposited on the membrane 130 by the photo-engraving process. After vapor-depositing the metal layer, as shown in FIGS. 14A and 14B, all the portions are removed except for the upper electrode covering the ink chamber 127, and a conductor 137*a* outwardly extending from the upper electrode 137. The conductor 137*a* and the lower electrode 117 are connected to a positive pole of the external power supply, and accordingly, the electric potential difference is generated between the upper and lower electrodes 137 and 117 when the electric current is supplied from an external power supply.

An ink supply hole is formed through the membrane 130 and upper electrode 137. The ink supply hole 190*a* formed through the upper electrode 137 is formed at the middle portion of the metal layer during the photo-engraving process for forming the upper electrode 137 and the conductor 137*a*, while the ink supply hole 190*b* formed through the membrane 130 is formed by dry etching after the ink supply hole 190*a* of the upper electrode 137 is formed.

Figure 15:
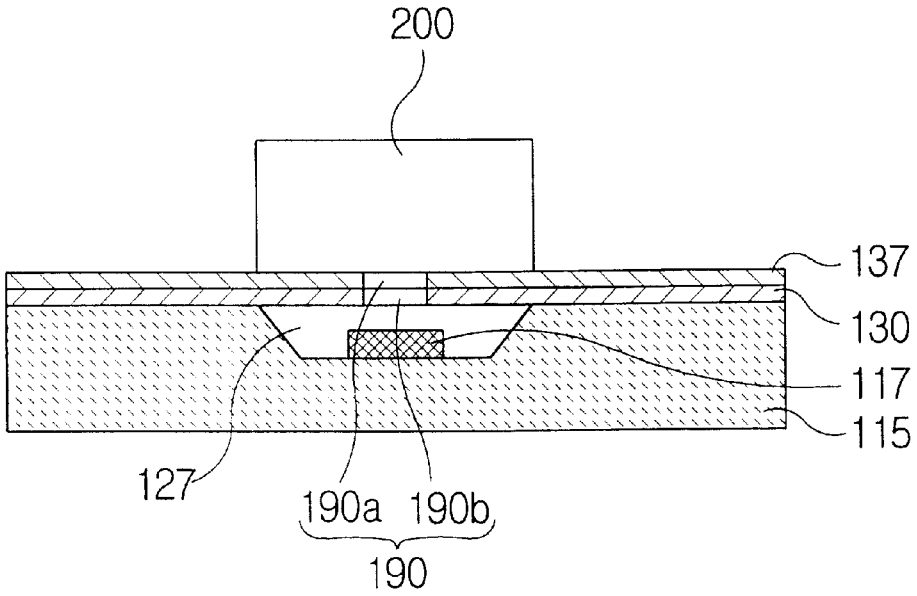
FIGS. 15 and 16 are sectional views of an ink jetting apparatus according to the present invention.

After completion of the ink supply hole 190, an ink bottle 200 is assembled on the upper portion of the membrane 130, and accordingly, the complete inkjetting apparatus shown in FIG. 15 is obtained.

Figure 16:
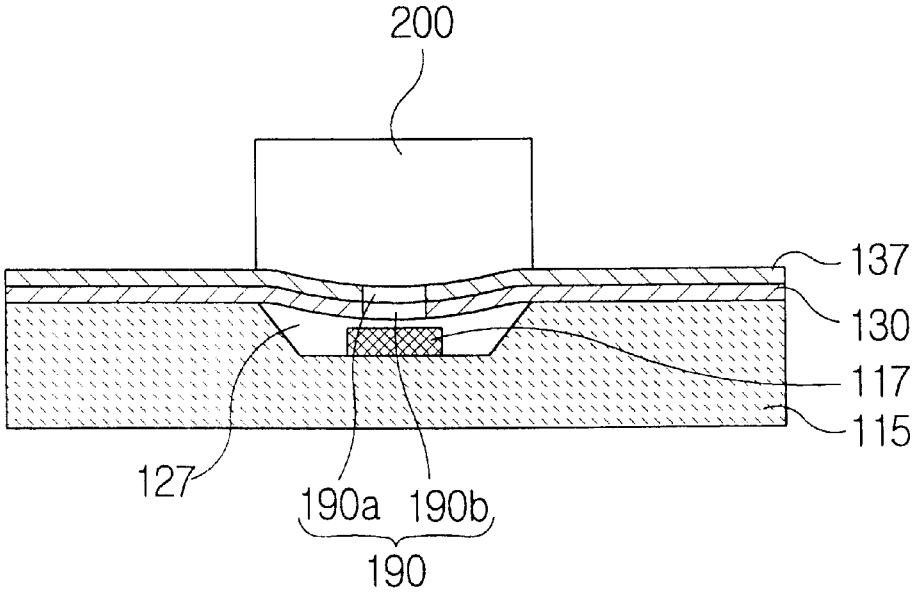

Hereinafter, the operation of the ink jetting apparatus according to the present invention will be described with reference to FIGS. 15 and 16.

The ink is supplied from the ink bottle 200 to the ink chamber 127 through the ink supply hole 190, and is filled in the ink chamber 127. When electricity is applied to the upper and lower electrodes 137 and 117, the electric potential difference is generated between upper and lower electrodes 137 and 117. By the electric potential difference, an electrostatic attraction is obtained through the above-mentioned formula ($F=e\ A\ V^2/2\ D^2$), and accordingly, as shown in FIG. 16, the membrane 130 is deformed and is curved inward to the ink chamber 127. Accordingly, the pressure in the ink chamber 127 increases, and the ink in the ink chamber 127 is jetted outward through the ink discharge channel 148 and the nozzle opening 149.

When the electricity supply to the upper and lower electrodes 137 and 117 is cut-off, the electric potential difference between the upper and lower electrodes 137 and 117 is not generated any longer, and accordingly, the membrane 130 recovers its original shape as shown in FIG. 15. Accordingly, the pressure in the ink chamber 127 decreases, and ink in the ink bottle 200 is sucked into the ink chamber 127 through the ink supply hole 190. The ink jetting operation is performed as the above processes are repeated.

According to the present invention, since the membrane 130 and the driving section 120 are integrally formed with each other, additional processes for making the membrane 130, and adhering the membrane 130 are not required. Further, additional materials for the membrane 130 such as a wafer, etc., are not required, and the membrane 130 can have the desired thin thickness. Accordingly, even with the low electric potential difference, the ink jetting apparatus is driven, efficiently.

Further, since the ink chamber 127 serves the function of a working fluid chamber, an additional working fluid chamber is not required. Accordingly, the ink jetting apparatus according to the present invention has a simpler structure and manufacturing process than the conventional ink jetting apparatus, which is comprised of a nozzle section and a driving section.

Further, the ink filled in the ink chamber 127 has a dielectric constant which is 80 times higher than air or vacuum. Accordingly, the electrostatic attraction obtained by the ink jetting apparatus according to the present invention through the above-mentioned formula (($F=e\ A\ V^2/2\ D^2$) is far higher than the electrostatic attraction obtained in a conventional ink jetting apparatus, which means the same electrostatic attraction can be obtained by the ink jetting apparatus of the present invention even with a lower electric potential difference, and the ink jetting apparatus is driven more rapidly.

As described above, according to the inkjetting apparatus and manufacturing method of the present invention, the manufacturing process and structure become simpler, and driving is performed more efficiently. As stated above, the preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. An electrostatic attraction type ink jetting apparatus, comprising:

a wafer having an ink chamber for receiving ink supplied from an external ink supply, and a nozzle hole extending from the ink chamber to an extreme end of the wafer, being open at the extreme end of the wafer;

a membrane laminated on the wafer;

a lower electrode disposed within said ink chamber; and an upper electrode disposed on an outer surface of the membrane, the membrane being deformed by electrostatic attraction generated while the electric potential difference is applied between the upper and lower electrodes, the membrane thus being curved inward to the ink chamber to press the ink in the ink chamber and to jet the ink outward through the nozzle hole.

2. The inkjetting apparatus as claimed in claim 1, wherein the nozzle hole extends from the ink chamber along the surface of the wafer to the extreme end of the board and open at the extreme end of the board.

3. The ink jetting apparatus as claimed in claim 1, wherein the membrane and upper electrode comprise an ink supply hole formed through the membrane and upper electrode for supplying ink to the ink chamber therethrough.

4. A method for making an electrostatic attraction type inkjetting apparatus, comprising the steps of:

1) forming an ink chamber and a nozzle hole by etching, the ink chamber for receiving ink supplied from an external ink supply and a nozzle hole extending from the ink chamber to an extreme end of a wafer and thus open at the extreme end of the wafer;

2) vapor-depositing a lower electrode in the ink chamber;

3) adhering a polyamide sheet on the wafer;

4) forming a membrane by etching the polyamide sheet; and 5) vapor-depositing an upper electrode on the membrane.

5. The method as claimed in claim 4, wherein the step of forming the ink chamber and nozzle hole is performed by wet-etching.

6. The method as claimed in claim 4, wherein the step of adhering the polyamide sheet is performed by lamination.

7. The method as claimed in claim 6, wherein the step of forming the membrane is performed by a dry-etching process.

8. The method as claimed in claim 4, further comprising the step of forming an ink supply hole through the membrane and upper electrode after the step of adhering the upper electrode, the ink supply hole serving the function of a supply channel for ink which is supplied from the external ink supply to the ink chamber.

9. The method as claimed in claim 8, wherein the step of forming the ink supply hole comprises the sub-steps of:

a) forming an ink supply hole in the upper electrode by photo-engraving the upper electrode; and b) forming the ink supply hole of the membrane by dry-etching the membrane.

10. An ink jetting apparatus, comprising:

a wafer having an ink chamber and an ink discharge channel etched in said wafer, said ink discharge channel leading transversely across said wafer to an edge of said wafer;

a lower electrode disposed on a bottom of said ink chamber on said wafer;

a flexible membrane covering said ink chamber and said ink discharge channel, said flexible membrane being disposed on top of said wafer;

an upper electrode covering said flexible membrane, said upper electrode being disposed on a top side of said membrane; and a power supply connected to both said upper electrode and said lower electrode providing a potential difference between said upper electrode and said lower electrode, causing said flexible membrane and said upper electrode to bow downward when power is applied to said upper electrode and said lower electrode forcing out ink via said ink discharge channel to an opening on said edge of said wafer.

11. The ink jetting apparatus of claim 10, wherein said upper electrode and said flexible membrane above said ink chamber being perforated by a hole, wherein an ink supply bottle lies on top of said upper electrode and supplies ink to said ink chamber through said hole when no power is applied to said upper electrode and said lower electrode.

12. The ink jetting apparatus of claim 10, wherein said flexible membrane is made out of polyamide.

* * * * *